US006179227B1

(12) United States Patent
Ren et al.

(10) Patent No.: US 6,179,227 B1
(45) Date of Patent: Jan. 30, 2001

(54) PRESSURE SWIRL GENERATOR FOR A FUEL INJECTOR

(75) Inventors: Wei-Min Ren, Yorktown; David Wieczorek, Seaford, both of VA (US)

(73) Assignee: Siemens Automotive Corporation, Auburn Hills, MI (US)

( * ) Notice: Under 35 U.S.C. 154(b), the term of this patent shall be extended for 0 days.

(21) Appl. No.: 09/370,848

(22) Filed: Aug. 10, 1999

Related U.S. Application Data

(63) Continuation-in-part of application No. 09/259,168, filed on Feb. 26, 1999, now Pat. No. 6,039,272, which is a continuation of application No. 08/795,672, filed on Feb. 6, 1997, now Pat. No. 5,875,972.

(51) Int. Cl.[7] ..... B05B 1/30; B05B 1/34

(52) U.S. Cl. ..... 239/497; 239/590.3; 239/483; 239/585.4

(58) Field of Search ..... 239/585.1, 583.4, 239/494, 496, 497, 486, 596, 590.3, 483

(56) References Cited

U.S. PATENT DOCUMENTS

| | | | | |
|---|---|---|---|---|
| 2,273,830 | | 2/1942 | Brierly et al. . | |
| 4,120,456 | | 10/1978 | Kimura et al. | 239/464 |
| 4,643,359 | | 2/1987 | Casey | 239/585 |
| 4,887,769 | * | 12/1989 | Okamoto et al. | 239/585.4 |
| 5,114,077 | | 5/1992 | Cerny et al. | 239/251 |
| 5,174,505 | * | 12/1992 | Shen | 239/585.1 |
| 5,207,384 | | 5/1993 | Horsting | 239/463 |
| 5,271,563 | | 12/1993 | Cerny et al. | 239/463 |
| 5,409,169 | * | 4/1995 | Saikalis et al. | 239/585.4 |
| 5,462,231 | | 10/1995 | Hall | 239/585.4 |
| 5,494,224 | | 2/1996 | Hall et al. | 239/585.5 |
| 5,625,946 | | 5/1997 | Wildeson et al. | 29/888.41 |
| 5,630,400 | | 5/1997 | Sumida et al. | 123/470 |
| 5,636,796 | | 6/1997 | Oguma | 239/533.12 |
| 5,678,767 | * | 10/1997 | Rahbar | 239/585.1 |
| 5,730,367 | * | 3/1998 | Pace et al. | 239/585.1 |
| 5,871,157 | | 2/1999 | Fukutomi et al. | 239/463 |
| 5,875,972 | | 3/1999 | Ren et al. | 239/463 |

FOREIGN PATENT DOCUMENTS

| | | |
|---|---|---|
| 2 140 626 | 4/1984 | (EP) . |
| 0241973 | 9/1990 | (JP) . |
| WO 99/10648 | 3/1999 | (WO) . |
| WO 99/10649 | 3/1999 | (WO) . |

OTHER PUBLICATIONS

"Geometrical Effects on Flow Characteristics of Gasoline High Pressure Direct Injector", 97FL–95, Authors W.M. Ren, J. Shen, J.F. Nally, Jr., Siemens Automotive.

* cited by examiner

*Primary Examiner*—Kevin Weldon

(57) ABSTRACT

A fuel injector with a valve body having an inlet, an outlet, and an axially extending fuel passageway from the inlet to the outlet. An armature located proximate the inlet of the valve body. A needle valve operatively connected to the armature. A valve seat proximate the outlet of the valve body. A swirl generator disk located proximate the valve seat. The swirl generator disk having at least one slot extending tangentially from a central aperture. A flat guide disk having a first surface, a second surface adjacent the flat swirl generator disk, a guide aperture, and at least one fuel passage having a wall extending between the first surface and the second surface. The wall includes an inlet, an outlet, and a transition region between the inlet and the outlet that defines a cross-sectional area of the at least one passage. The transition region is provided by a surface of the wall. The surface of the wall is configured to gradually change the direction of fuel flowing from the fuel passageway of a valve body to the flat swirl generator disk so that sharp corners in the fuel flow path are minimized.

12 Claims, 4 Drawing Sheets

PRESSURE SWIRL GENERATOR FOR A FUEL INJECTOR

CROSS-REFERENCE TO RELATED APPLICATIONS

This application is a continuation-in-part of U.S. application Ser. No. 09/259,168, filed Feb. 26, 1999 now U.S. Pat. No. 6,039,272 continuation application of U.S. application Ser. No. 08/795,672, filed Feb. 6, 1997 now U.S. Pat. No. 5,875,972. This application claims the right of priority to each of the prior applications. Furthermore, each of the prior applications is hereby in their entirety incorporated by reference.

BACKGROUND OF THE INVENTION

This invention relates to fuel injectors in general and particularly high-pressure direct injection fuel injectors. More particularly to high-pressure direct injection fuel injectors having a pressure swirl generator.

SUMMARY OF THE INVENTION

The present invention provides a fuel injector with a valve body having an inlet, an outlet, and an axially extending fuel passageway from the inlet to the outlet. An armature is located proximate the inlet of the valve body. A needle valve is operatively connected to the armature. A valve seat is located proximate the outlet of the valve body. A swirl generator that allows the fuel to form a swirl pattern on the valve seat is located in the valve body.

The swirl generator, preferably, includes two flat disks. One disk is a swirl generator disk having at least one slot extending tangentially from a central aperture. The other disk is a flat guide disk having a perimeter, a central aperture, and at least one fuel passage opening between the perimeter and the central aperture. The flat guide disk has a first surface, a second surface adjacent the flat swirl generator disk, a guide aperture, and at least one fuel passage having a wall extending between the first surface and the second surface. The wall includes an inlet, an outlet, and a transition region between the inlet and the outlet that defines a cross-sectional area of the at least one passage. The inlet is proximate the first surface. The outlet is proximate the second surface. The transition region is configured so that the cross-sectional area of the at least one fuel passage increases as the transition region approaches the outlet of the wall.

In a preferred embodiment, the transition region comprises an entrance section proximate the inlet and an exit section proximate the outlet. The exit section is an oblique surface of the wall or an arcuate surface of the wall. The entrance section is a linear surface of the wall that is substantially perpendicular to the first surface.

Preferably, the flat guide disk has a perimeter common to both the first surface and the second surface, and the at least one passage is located between the guide aperture and the perimeter. Each of the perimeter, the guide aperture, the inlet of the wall, and the outlet of the wall, has a substantially circular configuration. The at least one passage comprises a plurality of passages, and the valve seat includes a fuel outlet passage and the needle valve mates with a surface of the fuel outlet passage to inhibit fuel flow through the valve seat.

The present invention also provides a fuel injector having a valve body with an inlet, an outlet, and an axially extending fuel passageway from the inlet to the outlet. An armature located proximate the inlet of the valve body. A needle valve operatively connected to the armature. A valve seat located proximate the outlet of the valve body. A flat swirl generator disk adjacent the valve seat. The flat swirl generator disk includes a plurality of slots extending tangentially from a central aperture. A flat guide disk having a first surface, a second surface adjacent the flat swirl generator disk, a circular perimeter common to both the first surface and the second surface, a circular guide aperture, and a plurality of circular passages located between the circular guide aperture and the circular perimeter.

The plurality of circular fuel passages are uniformly dispersed around the circular guide aperture and aligned with a respective slot of the flat swirl generator disk. Each of the plurality of fuel passages has a wall extending between the first surface and the second surface. The wall includes a circular inlet having a first diameter and a circular outlet having a second diameter. The second diameter is greater than the first diameter.

The present invention also provides a method of adjusting flow capacity within a pressure swirl generator of a fuel injector. The fuel injector includes a valve body having a fuel passageway extending axially from an inlet to an outlet; an armature located proximate the inlet of the valve body; a needle valve operatively connected to the armature; a valve seat located proximate the outlet of the valve body; a flat swirl disk adjacent the valve seat; and a guide member that guides the needle valve. The method can be achieved by providing a guide member with a surface configured to gradually change the direction of fuel flowing from the fuel passageway of a valve body to the valve seat, and locating the guide member proximate the flat swirl generator disk.

In a preferred embodiment of the method, the guide member is a flat guide disk, and the surface is a surface of a wall that forms a passage extending between a first surface and a second surface of the flat swirl generator disk. The surface of the wall provides a transition region extending between an inlet proximate the first surface and an outlet proximate the second surface. The transition region is formed by coining the second surface so that the cross-sectional area of the outlet is greater than the cross-sectional area of the inlet.

BRIEF DESCRIPTION OF THE DRAWINGS

The accompanying drawings, which are incorporated herein and constitute part of this specification, illustrate presently preferred embodiments of the invention, and, together with a general description given above and the detailed description given below, serve to explain features of the invention.

DETAILED DESCRIPTION OF THE PREFERRED EMBODIMENT(S)

Figure 1:
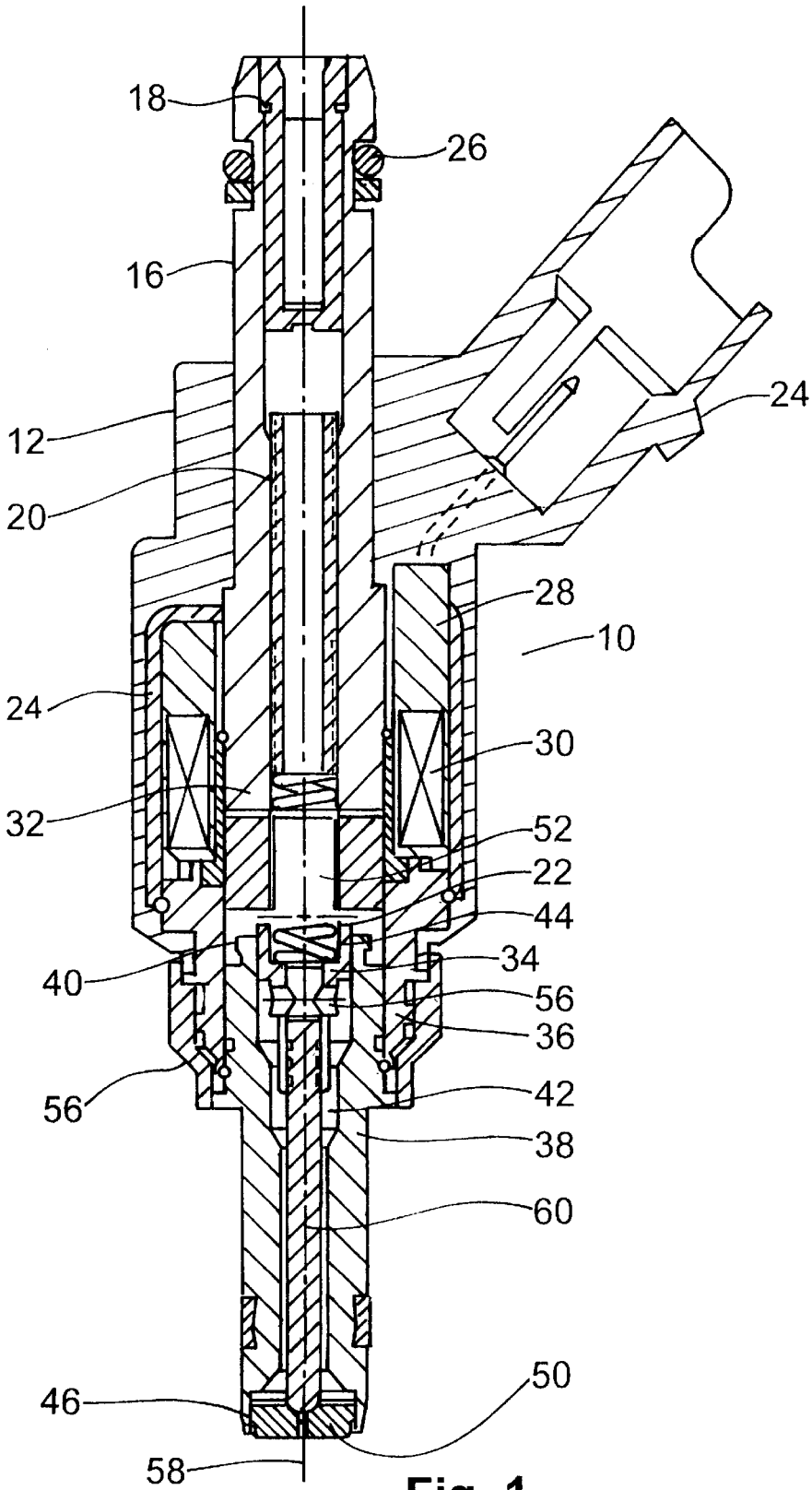
FIG. 1 is a cross-sectional view of a fuel injector taken along its longitudinal axis.

FIG. 1 illustrates an exemplary embodiment of a fuel injector of the preferred embodiment, particularly, a high-pressure direct injection fuel injector. The fuel injector 10 has an overmolded plastic member 12 encircling a metallic housing member 14. A fuel inlet 16 with an in-line fuel filter 18 and an adjustable fuel inlet tube 20 are disposed within the overmolded plastic member 12 and metallic housing member 14. The adjustable fuel inlet tube 20, before being secured to the fuel inlet 16, is longitudinally adjustable to vary the length of an armature bias spring 22, which adjusts the fluid flow within the fuel injector 10. The overmolded plastic member 12 also supports a connector 24 that connects the fuel injector 10 to an external source of electrical potential, such as an electronic control unit (ECU, not shown). An O-ring 26 is provided on the fuel inlet 16 for sealingly connecting the fuel inlet 16 with a fuel supply member, such as a fuel rail (not shown).

The metallic housing member 14 encloses a bobbin 28 and a solenoid coil 30. The solenoid coil 30 is operatively connected to the connector 24. The portion 32 of the inlet tube 16 proximate the bobbin 28 and solenoid coil 30 functions as a stator. An armature 34 is axially aligned with the inlet tube 16 by a valve body shell 36 and a valve body 38.

The valve body 38 is disposed within the valve body shell 36. An armature guide eyelet 40 is located at the inlet of the valve body. An axially extending fuel passageway 42 connects the inlet 44 of the valve body with the outlet 46 of the valve body 38. A valve seat 50 is located proximate the outlet 46 of the valve body. Fuel flows in fluid communication from the fuel supply member (not shown) through the fuel inlet 16, the armature fuel passage 52, and valve body fuel passageway 42, and exits the valve seat fuel outlet passage 54.

The fuel passage 52 of the armature is axial aligned with the fuel passageway 42 of the valve body 38. Fuel exits the fuel passage 52 of the armature through a pair of transverse ports 56 and enters the inlet 44 of the valve body 38. The armature 34 is magnetically coupled to the portion 32 of the inlet tube 16 that serves as a stator. The armature 34 is guided by the armature guide eyelet 40 and axially reciprocates along the longitudinal axis 58 of the valve body in response to an electromagnetic force generated by the solenoid coil 30. The electromagnetic force is generated by current flow from the ECU through the connector 24 to the ends of the solenoid coil 30 wound around the bobbin 28. A needle valve 60 is operatively connected to the armature 34 and operates to open and close the fuel outlet passage 54 in the valve seat, which allows and prohibits fuel from exiting the fuel injector 10.

Figure 2:
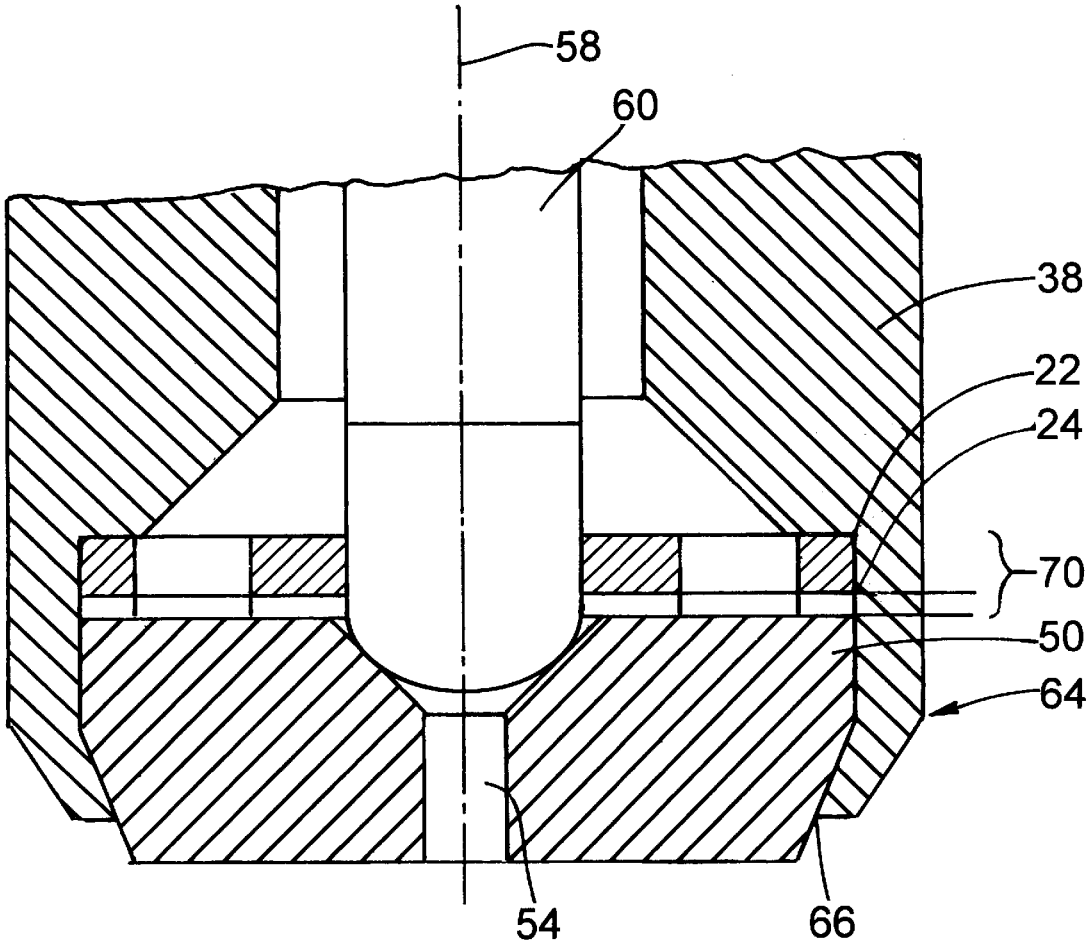
FIG. 2 is an enlarged cross-sectional view of the valve seat portion of the fuel injector shown in FIG. 1.

The valve seat 50 is positioned proximate the outlet 46 of the valve body 38. A crimped end section 64 of the valve body 38 engages the valve seat 50, and a weld joint 66 secures and seals the valve body 38 and the valve seat 50. A swirl generator 70 is located upstream of the valve seat 50 in the fuel passageway 42 of the valve body 38. The swirl generator 70 allows fuel to form a swirl pattern on the valve seat 50. The swirl generator 70, preferably, as illustrated in FIG. 2, includes a pair of flat disks, a guide disk 72 and a swirl generator disk 74.

Figure 4:
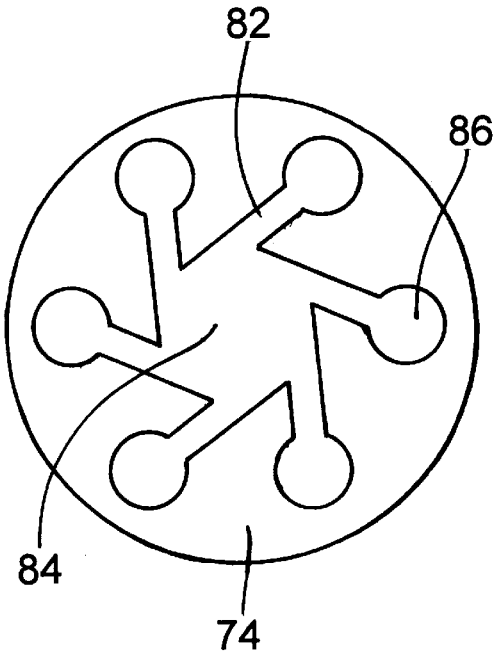
FIGS. 3 and 4 are plan views of the swirl generator components of the fuel injector shown in FIGS. 1 and 2.
Figure 3:
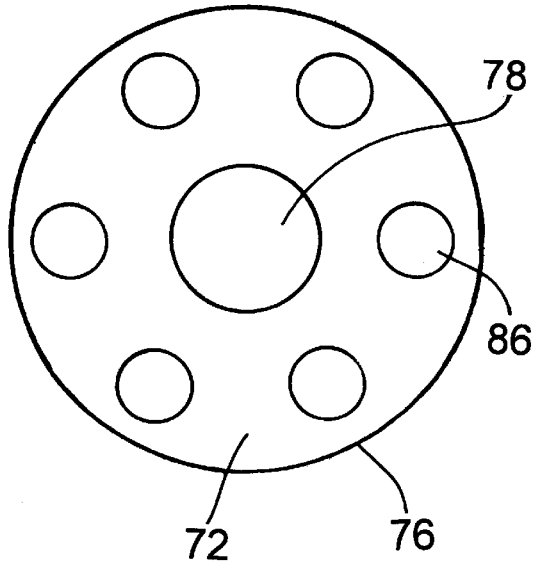

The guide disk 72, illustrated in FIG. 3, has a perimeter 76, a central aperture 78, and at least one fuel passage 80 between the perimeter 76 and the central aperture 78. The central aperture 78 guides the needle valve 60 as the needle valve 60 mates with a surface of the fuel outlet passage 54 to inhibit fuel flow through the valve seat. The at least one fuel passage 80 is, preferably, a plurality of fuel passages 80 that guides fuel to the swirl generator disk 74. The swirl generator disk 74, illustrated in FIG. 4, has a plurality of slots 82 that corresponds to the plurality of fuel passages 80 in the guide disk 72. Each of the slots 82 extends tangentially from the central aperture 84 toward the respective fuel passage opening 86, and provides a tangential fuel flow path for fuel flowing through the swirl generator disk 74 from the fuel passages 80 of the flat guide disk 72.

Figure 2A:
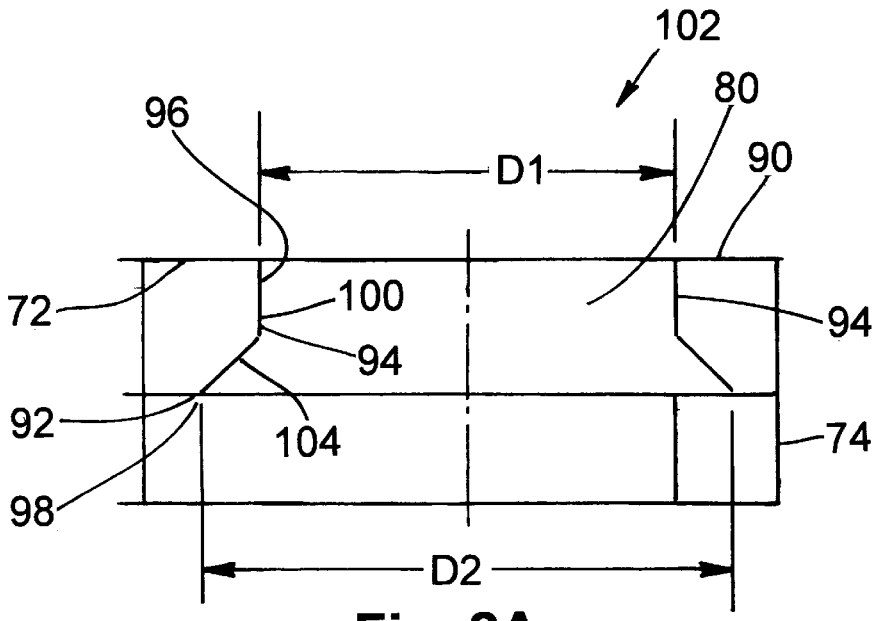
FIG. 2A is an enlarged partial cross-sectional view of a portion of the swirl generator components shown in FIG. 2.

The flat guide disk 72, illustrated in FIG. 2A, has a first surface 90 and a second surface 92. The second surface 92 is located adjacent the flat swirl generator disk 74. Each of the fuel passages 80 has a wall 94 extending between the first surface 90 and the second surface 92 of the flat guide disk 72. The wall 94 includes an inlet 96, an outlet 98, and a transition region 100 between the inlet 96 and the outlet 98.

The inlet 96 of the wall 94 is located proximate the first surface 90. The outlet 98 of the wall 94 is located proximate the second surface 92. The transition region 100 is provided by the surface of the wall 94. The transition region 100 defines the cross-sectional area of fuel passage 80. The surface of the wall 94 is configured to gradually change the direction of fuel flowing from the fuel passageway 42 of a valve body 38 to the flat swirl generator disk 74. To achieve the gradual flow direction change, the surface of the wall 94, preferably, is configured so that sharp corners in the fuel flow path are prevented or minimized. The surface of the wall 94 provides the transition region 100 with a cross-sectional area that increases as the transition region 100 approaches the outlet 98 of the wall 94.

The transition region 100 has an entrance section 102 proximate the inlet 96., and an exit section 104 proximate the outlet 98. The exit section 104 is, preferably, an oblique surface of the wall 94 or an arcuate surface of the wall 94. Preferably, the oblique surface of the wall 94 forms an acute angle with the second surface 92, and an arcuate surface of the wall 94 forms a radius of curvature between the entrance section 102 and the outlet 98 of the wall 94. The entrance section 102 is, preferably, a linear surface of the wall 94 that is substantially perpendicular to the first surface 90.

In the preferred embodiment, each of the perimeter 76, the guide aperture 78, the inlet 96 of the wall 94, and the outlet 98 of the wall 94, has a substantially circular configuration. Thus, the flat guide disk 72, preferably, has a circular perimeter 76 common to both the first surface 90 and the second surface 92, a circular guide aperture 78, and a plurality of circular passages 80 located between the circular guide aperture 78 and the circular perimeter 76, the plurality of circular fuel passages 80 being uniformly dispersed around the circular guide aperture 78. Each of the plurality of circular fuel passages 80 has a wall 94 with a circular inlet 96 and a circular outlet 98. The circular inlet 96 has a first diameter D1 and the circular outlet 98 has a second diameter D2. The second diameter D2 of the circular outlet 98 is greater than the first diameter D1 of the circular inlet 96.

The dimensional difference between the first and second diameters D1, D2, preferably, is achieved by having a uniform transition region 100. For example, the oblique or arcuate surface that provides the exit section 104 and the linear surface that provides the entrance section 102 are substantially identically disposed about a central axis of the passage 80. The exit and entrance sections 102, 104 configurations of the preferred embodiment provide for the increase in the cross-sectional area defined by the transition region 100 as the transition region 100 approaches the outlet 98 of the wall 94. The increasing cross-sectional area could also be achieved with a different entrance section 102 than the linear surface of the preferred embodiment. In particular, the entrance section 102, similar yet transposed to the preferred exit section 104, could also be an oblique or arcuate surface of the wall 94. With each of the entrance and exit sections 102, 104 being an oblique or arcuate surface, the transition region 100 should have an intermediate section between the entrance and exit sections 102, 104 that is a linear surface of the wall 94 so that the flow direction of the fuel is gradually changed.

Although a uniform transition region 100 is preferred, a transition region 100 with a non-uniform configuration about the central axis could be employed. The non-uniform configuration should be arrange so that the wall 94 of the passage 80 gradually changes the direction of fuel flowing from a fuel passageway of a valve body to the valve seat. In order to achieve this gradual flow direction change, the transition region 100 could have, for example, an exit section 104 with an oblique or arcuate surface of the wall 94 located on one side of the central axis closest to the central aperture 78, and a linear surface of the wall 94 of the other side of the central axis. The non-uniform transition region 100 would also provide for an increase in the cross-sectional area defined by the transition region 100 as the transition region 100 approaches the outlet 98 of the wall 94 so that the flow direction of the fuel is gradually changed.

The present invention also provides a method of adjusting flow capacity within a pressure swirl generator of a fuel injector. The fuel injector includes a valve body having a fuel passageway extending axially from an inlet to an outlet; an armature located proximate the inlet of the valve body; a needle valve operatively connected to the armature; a valve seat located proximate the outlet of the valve body; a flat swirl disk adjacent the valve seat, and a guide member that guides the needle valve. The method can be achieved by providing a guide member with a surface configured to gradually change the direction of fuel flowing from a fuel passageway of a valve body to the valve seat, and locating the guide member proximate the flat swirl generator disk.

In a preferred embodiment of the method, the guide member is a flat guide disk, and the surface is provided by a wall 94 of a passage 80 extending between a first surface 90 and a second surface 92. The wall 94 has a transition region 100 extending between an inlet 96 proximate the first surface 90 and an outlet 98 proximate the second surface 92. The transition region 100 is formed by coining the second surface 92 so that the cross-sectional area of the outlet 98 is greater than the cross-sectional area of the inlet 96.

Figure 5:
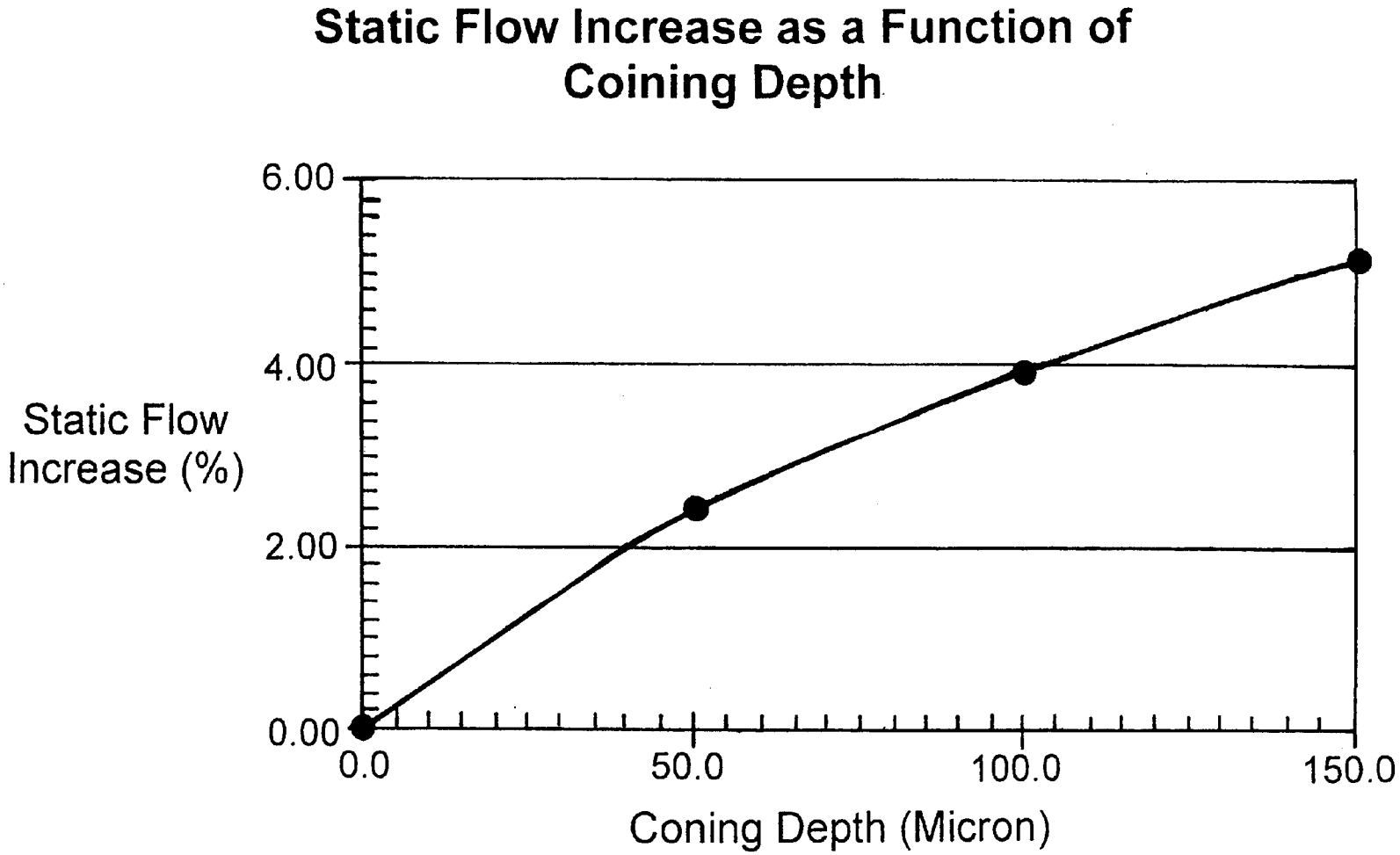
FIG. 5 is a graph of computational fluid dynamic simulations of the relationship of the static flow rate of the fuel injector shown in FIGS. 1 and 2.

FIG. 5 illustrates a computational fluid dynamic (CFD) simulation of a typical relationship between the depth the second surface 92 of the flat guide disk is coined and the static flow rate through fuel injector of the preferred embodiment. As the coining depth is increased, the static flow rate increases until a maximum flow rate is obtained. Thus, by coining the second surface to different depths, different flow rate can be obtained and adjusted for the intended application. The preferred flat guide disk has an axial thickness of approximately 0.44 mm and the diameter of the inlet 96 proximate the first surface 90 is approximately 1.0 mm. Before coining, the outlet 98 proximate the second surface 92 has a diameter approximately equal to the diameter of the inlet 96 proximate the first surface 90. After coining the second surface 92, the outlet 98 has a second diameter D2 that is greater than the first diameter D1 of the inlet 96 proximate the first surface 90. For example, as illustrated in FIG. 5, when the second surface 92 is coined and achieves the largest increase in the static flow rate, 150 micron coining depth, the second diameter D2 is approximately 15% larger than the first diameter D1. This increase in the second diameter D2, which is achieved by employing a transition region 100 of the wall 94 that has a surface configured to gradually change the direction of fuel flow, results in CFD calculations yielding approximately a 5% increase in the static flow rate. Actual hardware tests of the preferred embodiment of the fuel injector yield over a 10% increase in the static flow rate.

While the invention has been disclosed with reference to certain preferred embodiments, numerous modifications, alterations and changes to the described embodiments are possible without departing from the sphere and scope of the invention, as defined in the appended claims and equivalents thereof. Accordingly, it is intended that the invention not be limited to the described embodiments, but that it have the full scope defined by the language of the following claims.

What is claimed is:

1. A fuel injector comprising:

a valve body having an inlet, an outlet, and an axially extending fuel passageway from the inlet to the outlet;

an armature proximate the inlet of the valve body;

a needle valve operatively connected to the armature;

a valve seat proximate the outlet of the valve body; and a flat swirl generator disk adjacent the valve seat, the flat swirl generator disk including at least one slot extending tangentially from a central aperture; and a flat guide disk having a first surface, a second surface adjacent the flat swirl generator disk, a guide aperture, and at least one fuel passage having a wall extending between the first surface and the second surface, the wall including an inlet, an outlet, and a transition region between the inlet and the outlet that defines a cross-sectional area of the at least one passage, the inlet being proximate the first surface, the outlet being proximate the second surface, the transition region being configured so that the cross-sectional area of the at least one fuel passage increases as the transition region approaches the outlet of the wall.

2. The fuel injector of claim 1, wherein the transition region comprises an entrance section proximate the inlet and an exit section proximate the outlet.

3. The fuel injector of claim 2, wherein the exit section comprises at least one of an oblique surface of the wall and an arcuate surface of the wall.

4. The fuel injector of claim 3, wherein the entrance section comprises a linear surface of the wall that is substantially perpendicular to the first surface.

5. The fuel injector of claim 4, wherein the flat guide disk further comprises a perimeter common to both the first surface and the second surface; and wherein the at least one passage is located between the guide aperture and the perimeter.

6. The fuel injector of claim 5, wherein the perimeter, the guide aperture, the inlet of the wall, and the outlet of the wall, each comprises a substantially circular configuration.

7. The fuel injector of claim 6, wherein the at least one passage comprises a plurality of passages.

8. The fuel injector of claim 7, wherein the valve seat includes a fuel outlet passage and the needle valve mates with a surface of the fuel outlet passage to inhibit fuel flow through the valve seat.

9. A fuel injector comprising:

a valve body having an inlet, an outlet, and an axially extending fuel passageway from the inlet to the outlet;

an armature proximate the inlet of the valve body;

a needle valve operatively connected to the armature;

a valve seat proximate the outlet of the valve body; and a flat swirl generator disk adjacent the valve seat, the flat swirl generator disk including a plurality of slots extending tangentially from a central aperture; and a flat guide disk having a first surface, a second surface adjacent the flat swirl generator disk, a circular perimeter common to both the first surface and the second surface, a circular guide aperture, a plurality of circular passages located between the circular guide aperture and the circular perimeter, the plurality of circular fuel passages being uniformly dispersed around the circular guide aperture and aligned with a respective slot of the flat swirl generator disk, each of the plurality of fuel passages having a wall extending between the first surface and the second surface, the wall including a circular inlet having a first diameter and a circular outlet having a second diameter, the second diameter being greater than the first diameter.

10. A method of adjusting flow capacity within a pressure swirl generator of a fuel injector, the fuel injector including a valve body having an inlet, an outlet, and an axially extending fuel passageway from the inlet to the outlet, an armature proximate the inlet of the valve body, a needle valve operatively connected to the armature, a valve seat proximate the outlet of the valve body, a flat swirl generator disk adjacent the valve seat, the flat swirl generator disk including at least one slot extending tangentially from a central aperture, and a guide member that guides the needle valve, the method comprising:

locating a flat guide disk as the guide member, the flat guide disk having a wall that forms a passage extending between a first surface and a second surface of the flat guide disk, the wall having a transition region extending between an inlet proximate the first surface and an outlet proximate the second surface, the transition region being configured to change the direction of fuel flowing from the fuel passageway of the body to the valve seat and;

locating the guide member proximate the flat swirl generator disk.

11. The method of claim 10, wherein the transition region is formed by coining the second surface.

12. The method of claim 11, wherein the second surface is coined so that the cross-sectional area of the outlet is greater than the cross-sectional area of the inlet.

* * * * *